US006664726B2

(12) United States Patent
Magai

(10) Patent No.: US 6,664,726 B2
(45) Date of Patent: Dec. 16, 2003

(54) FLUORESCENT LAMP WITH A BY-PASS MEANS IN THE DISCHARGE SPACE RESULTING IN LOW STARTING VOLTAGE

(75) Inventor: István Magai, Biatorbagy (HU)

(73) Assignee: General Electric Company, Schenectady, NY (US)

( * ) Notice: Subject to any disclaimer, the term of this patent is extended or adjusted under 35 U.S.C. 154(b) by 12 days.

(21) Appl. No.: 09/683,491

(22) Filed: Jan. 8, 2002

(65) Prior Publication Data

US 2003/0127964 A1 Jul. 10, 2003

(51) Int. Cl.[7] ..... H01J 5/02; H01J 19/54

(52) U.S. Cl. ..... 313/493; 313/605; 313/609; 313/610; 313/611; 313/634; 445/22; 315/56; 315/58

(58) Field of Search ..... 313/493, 595, 313/634, 636, 111–114, 318.12, 609, 573, 484–486, 605, 610, 611; 315/56–63; 445/22

(56) References Cited

U.S. PATENT DOCUMENTS 4,853,591 A * 8/1989 Klein et al. ..... 313/493
5,767,618 A 6/1998 Maya et al. ..... 313/493

* cited by examiner

*Primary Examiner*—Nimeshkumar D. Patel
*Assistant Examiner*—Sikha Roy
(74) *Attorney, Agent, or Firm*—Fay, Sharpe, Fagan, Minnich & McKee, LLP

(57) ABSTRACT

This invention relates to a fluorescent lamp with a discharge vessel enclosing a discharge path and containing a gas fill. The gas fill may be by excited by a discharge arc. The discharge vessel has at least two sections located adjacent to each other. There are bypass means for providing a bypass path for the gas discharge during a startup of the lamp between the two adjacent sections of the discharge vessel. The bypass path results in a short-cut across the impedance of a portion of the discharge path. A method for starting a discharge arc of the fluorescent lamp is also disclosed. In the method, a voltage is applied between two electrodes across the discharge path, and a bypass path is provided between two ends of a bypassed part of the discharge path. The discharge path is divided into a bypassed part and a remaining part. The combined impedance of the bypass path and the associated bypassed part is selected to be lower than the impedance of the associated bypassed part, and thereby a relatively increased voltage is provided across the remaining part. The gas fill is excited in the remaining part of the discharge path with the help of the increased voltage. Thereafter the impedance of the remaining part is lowered and the voltage across the bypassed part is increased. Finally, the gas fill is excited in the bypassed part by the relatively increased voltage across the bypassed part.

11 Claims, 5 Drawing Sheets

FLUORESCENT LAMP WITH A BY-PASS MEANS IN THE DISCHARGE SPACE RESULTING IN LOW STARTING VOLTAGE

BACKGROUND OF INVENTION

This invention relates to fluorescent lamps of the type comprising an elongated discharge vessel. The discharge vessel encloses a discharge path. The discharge vessel contains a gas fill which is excitable from a non-excited state into an excited state by a discharge arc in the operating state of the lamp.

The invention further relates to a method for starting a discharge arc through the elongated discharge path in the discharge vessel of such fluorescent lamp.

Low pressure discharge lamps are well known in the art. These lamps contain a gas fill which radiates UV light when excited by a discharge arc. The UV light is converted to visible light by a suitable light powder on the surfaces of the discharge vessel which is made by glass in most cases. The discharge arc is generated by a suitable voltage applied to a pair of electrodes at the two ends of the discharge path. The achieved light output is a function of the length of the discharge path, and it is sought to make the discharge path as long as possible.

However, a long discharge path requires a relatively high starting voltage between the electrodes of the lamp. In turn, the high voltage requires special electronic circuits because the high voltage must be applied only during the start-up phase of the discharge. As the discharge arc develops and the gas fill is excited, the overall impedance across the discharge arc drops, and a relatively low voltage level is sufficient to maintain the discharge process in the lamp.

Therefore, when the discharge across the discharge path has stabilized, the built-in electronics in the lamp detects the current level through the discharge path, and reduces the voltage applied to the electrodes. These electronics are not only expensive, but also bulky. The electronics system could be significantly simplified if the starting voltage across the electrodes of the discharge vessel could be lower.

A flat compact fluorescent lamp is disclosed in U.S. Pat. No. 5,767,618. This lamp contains a gas fill which is enclosed in a discharge vessel. A spiral-shaped discharge path is formed in the discharge vessel which latter is constituted by a bottom and top panel. The discharge path contains adjacent sections which are separated from each other by a convoluted wall. The wall is a part of the bottom panel, and an edge of the wall is in close proximity to the top panel, so a narrow gap exists between the wall and the top panel. It is recognized in U.S. Pat. No. 5,767,618 that arching may develop across the gap between the wall and the top panel. This arching is regarded as a negative effect. The U.S. Pat. No. 5,767,618 describes a lamp structure where the arching is suppressed. It is not recognized or implied that the cross-arching between the adjacent sections of the lamp could be put to use during the start-up phase of the lamp.

Therefore, there is a particular need for a method for starting the discharge arc in fluorescent lamps with a relatively reduced voltage, so that the electronics of the lamp could be made simpler and cheaper, or some parts of the electronics could be dispensed with completely. Also, there is a need for a fluorescent lamp which would require lower starting voltage, and which at the same time may be manufactured in a simple manner with existing technologies.

SUMMARY OF INVENTION

In an embodiment of the present invention, there is provided a fluorescent lamp comprising an elongated discharge vessel which encloses a discharge path. The discharge vessel contains a gas fill. The gas fill is excitable from a non-excited state into an excited state by a discharge arc in the operating state of the lamp. The discharge path has a first impedance in a non-excited state. The gas fill is of the type where the impedance of the gas is lower in the excited state than in the non-excited state. The discharge vessel has at least two sections located adjacent to each other, and electrode means for generating a discharge arc across the discharge path in the discharge vessel. There is bypass means for providing a bypass path for the gas discharge during a startup of the lamp between the two adjacent sections of the discharge vessel. The bypass path results in a short-cut across the impedance of at least a portion of the discharge path when the gas in said portion is in the non-excited state.

According to another embodiment of the invention, there is provided a method for starting a discharge arc through an elongated discharge path in a discharge vessel of a fluorescent lamp, where the discharge vessel contains a gas fill which is excitable from a non-excited state into an excited state by the discharge arc in the operating state of the lamp. The method is applicable with such gas fills where the impedance of the gas fill is lower in the excited state than in the non-excited state. The method comprises the following steps. A voltage is applied between two electrodes across the discharge path in the discharge vessel, where the gas fill in the discharge path between the electrodes has a first impedance in a non-excited state. A bypass path is provided between two ends of a bypassed part of the discharge path, thereby dividing at least a portion of the discharge path into a bypassed part and at least one remaining part. The combined impedance of the bypass path and the associated bypassed part is selected to be lower than the impedance of the associated bypassed part of the elongated discharge vessel, when the gas in at least a part of said bypassed part is in the non-excited state. Thereby a relatively increased voltage is provided across the remaining part of the discharge path. The gas fill in the remaining part of the discharge path is excited into the excited state with the help of the increased voltage across the remaining part. As a result, the impedance of the remaining part is lowered and the voltage across the bypassed part is relatively increased. Finally, the gas fill is excited in at least a part of the bypassed part by the relatively increased voltage across the bypassed part.

The suggested fluorescent lamp thus requires a lower starting voltage on the electrodes because the available starting voltage needs not generate the discharge arc across the full length of the discharge path. Instead, the discharge path is effectively divided into shorter sections which are started after each other. The shorter sections have a lower impedance, and may be excited by a lower starting voltage.

The method and the fluorescent lamp implementing the method ensures a gradual, softer startup of the discharge arc, while the lamp may be manufactured at a lower cost.

BRIEF DESCRIPTION OF DRAWINGS

The invention will now be described with reference to the enclosed drawings.

DETAILED DESCRIPTION

Figure 1:
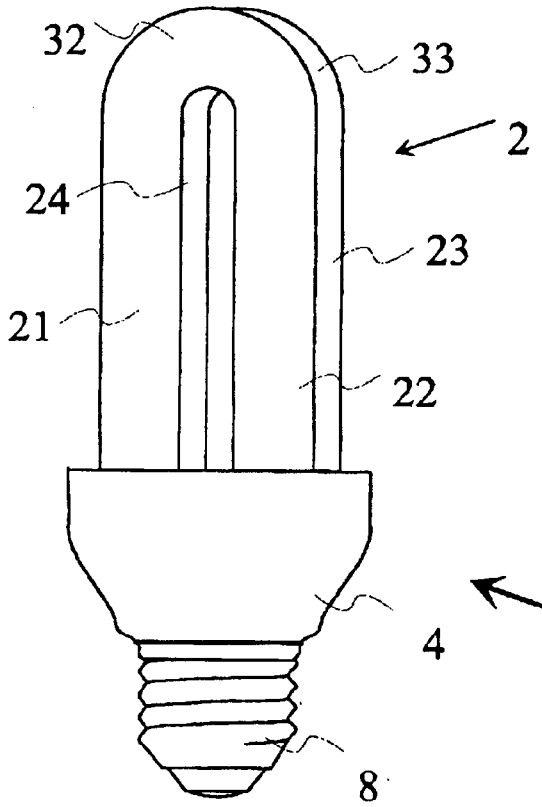
FIG. 1 is a side view of the discharge tube having four parallel, vertically oriented discharge tube sections.
Figure 2:
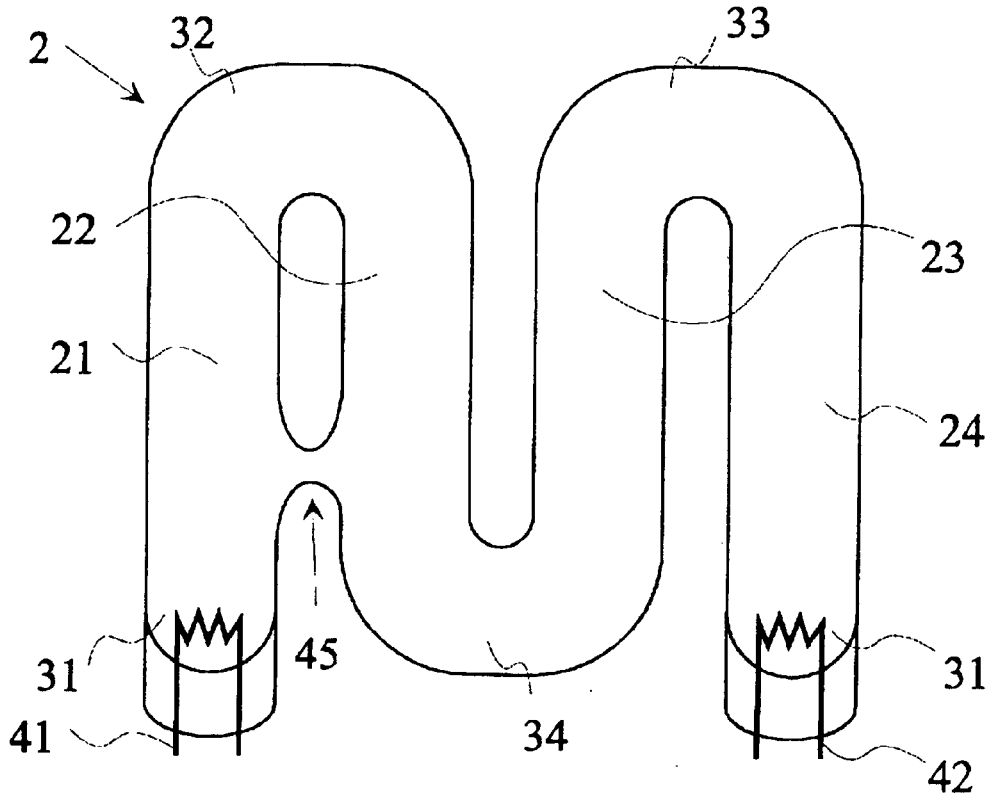
FIG. 2 is a schematic folded-out view of the discharge tube of the discharge lamp shown in FIG. 1.
Figure 3:
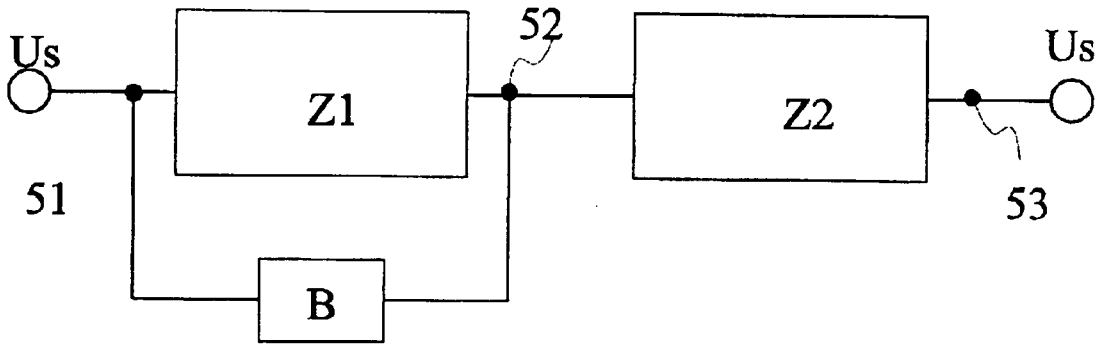
FIG. 3 illustrates the equivalent impedance circuit of the discharge tube shown in FIG. 2.

Referring now to FIGS. 1 and 2, there is shown a low pressure arc discharge lamp 1. The lamp 1 has a discharge vessel in the form of a discharge tube 2, the ends 31 of which are inserted into a lamp housing 4 or base terminal. The lamp 1 of FIG. 1 has four straight discharge tube sections 21, 22, 23 and 24, which are interconnected through bent sections 32, 33, 34 at the upper and lower ends of the tube sections 21–24. It is noted that the proportions of FIG. 3 are not to scale, and the straight tube sections 21–24 are normally longer than they appear in FIG. 2, and in this respect FIG. 2 is a schematic drawing only, illustrating the operating principle of the discharge tube 2.

The discharge tube 2 is mechanically supported by the lamp housing 4. The lamp housing 4 surrounds the ends 31 of the discharge tube 2. More precisely, the sealed ends 31 of the tube sections 21, 24 are within the lamp housing 4while the major part of the tube sections 21–24 is external to the lamp housing 4. Electrodes 41, 42 are placed in the discharge tube 2 at the ends 31. The electrodes 41, 42 act as means for generating a discharge arc across the discharge path in the discharge tube 2. The lamp 1 is of a type where light is emitted by a phosphor layer deposited on the inner surface of the discharge tube 2. Such a discharge lamp arrangement is known by itself. In a typical embodiment, the lamp housing 4 is equipped with a screw terminal 8 which fits into a standard screw socket (not shown).

In this manner, the fluorescent lamp 1 comprises an elongated discharge vessel enclosing a discharge path. The discharge tube 2 constituting the discharge vessel contains a gas fill the composition of which is known per se. In the operating state of the lamp, the gas fill is excited from a non-excited state into an excited state by a discharge arc sustained by the electrodes 41, 42 in the ends 31 of the tube 2. During an initial stage of the excitation, the gas is ionized and the number of charge carriers in the gas increases. When density of the charge carriers reaches a certain threshold, the ionization suddenly increases through collisions between the gas particles which results in an increased current through the gas, though the voltage across the discharge path does not increase. When this state has been reached, the increased discharge current across the discharge path remains even if the voltage across the discharge path is lowered. The discharge vessel behaves initially as an Ohmic impedance and the discharge path has a first impedance in a non-excited state. But, as the discharge current increases without the corresponding increase of the electrode voltage, it may be also interpreted so that the impedance of the gas is lower in the excited state than in the non-excited state.

As best seen in FIG. 2, the tube sections 21 and 22 of the discharge tube 2 are located adjacent to each other. Bypass means are inserted between the tube section 21 and 22. In the lamp 1 shown in FIG. 1, the bypass means are realized as a lead-through connection 45 between the tube sections 21 and 22 of the discharge tube 2. The lead-through connection 45 provides a bypass path for the gas discharge during a startup of the lamp 1 between the two adjacent tube sections 21 and 22 of the discharge tube. The startup of the lamp 1 is the short time interval between the switching on of the electric power to the lamp and the time when the discharge arc in the discharge vessel has stabilized. The bypass path through the lead-through connection 45 results in a short-cut across the impedance of that portion of the discharge path which is constituted by the tube section 21, the bent section 32 and the tube section 22. As will be explained below, this short-cut is effective only when the gas in the relevant portion of the discharge path is in the non-excited state.

Due to the bypass path, the discharge arc in the discharge tube 2 may be started with a lower starting voltage applied to the electrodes 41, 42. This is explained with reference to FIGS. 2 and 3.

When the discharge arc is to be generated, a starting voltage Us is applied between the two electrodes 41, 42. Apparently, this starting voltage Us is effective across the discharge path in the discharge tube 2. The discharge path between the electrodes 41, 42 has a certain first impedance in a non-excited state of the gas fill. This impedance is a sum of the impedances of the straight tube sections 21–24 and the bent tube sections 32–34. The total impedance of the tube 2 may be considered as the sum of impedances Z1 and Z2 connected in series as shown in FIG. 3 where impedance Z1 is a sum of the impedance of tube sections 21, 32 and 22, while impedance Z2 is a sum of the impedance of tube sections 34, 23, 33 and 24. As mentioned above, the lead-through connection 45 behaves as a bypass path between two ends of a bypassed part of the discharge path in the discharge tube 2. Apparently, the bypassed part of the discharge path corresponds to the tube sections 21, 32 and 22 in FIG. 2 because these sections are bypassed by the lead-through connection 45. In this manner, a portion of the discharge path in the discharge tube 2 is divided into a bypassed part—the tube sections 21, 32 and 22—and a remaining part, namely tube sections 34, 23, 33 and 24. The impedance of the bypass path, i.e. that of the lead-through connection 45, is denoted as the impedance B and the total impedance of the discharge tube 2 may be treated as the impedance circuit shown in FIG. 3.

Now the combined impedance of the bypass path and the associated bypassed part is selected to be lower than the impedance of the associated bypassed part. With other words, the value of the impedance B is selected so that the impedance between the nodes 51 and 52 is lower than the impedance Z1 itself. Though this will be true for most values of the impedance B when the gas in at least a part of the bypassed part is in the non-excited state, it is preferred that the impedance of the bypass path, i.e. the value of the impedance B is selected to be substantially lower than the impedance of the associated bypassed part, i.e. the impedance Z1 .

As a result of the lower impedance between the nodes 51 and 52, the proportion of the starting voltage Us falling on the impedance Z2 between the nodes 52 and 53 will increase. As explained above, the impedance Z2 equals the impedance of the remaining part of the discharge path in the discharge tube 2, corresponding to the tube sections 34, 23, 33 and 24. With other words, a relatively increased voltage appears across the remaining part of the discharge path.

If the impedance B of the bypass is much lower than the impedance Z2, practically the total starting voltage Us will fall across the impedance Z2. If the impedances Z1 and Z2 are approximately equal, it means that the starting voltage falling on the tube sections 34, 23, 33 and 24 has doubled as a result of the bypass.

The gas fill in the remaining part of the discharge path is subsequently excited into the excited state with the help of the increased starting voltage across the remaining part. With other words, a discharge arc is generated in the remaining part of the discharge path, i.e. through the tube sections 34, 23, 33 and 24. The discharge will have initially a limited current, the limitation mainly caused by the physical dimensions of the bypass, i.e. the lead-through connection 45.

However, as the discharge arc in the tube sections 34, 23, 33 and 24 develops, the impedance of the remaining part decreases due to the physical processes described above. This decrease of the impedance Z2 between the nodes 52 and 53 will result in a decrease of the voltage proportion falling on the impedance Z2, i.e. the impedance of the remaining part. As the voltage across the remaining part, i.e. the tube sections 34, 23, 33 and 24 decreases, the proportion of the starting voltage Us across the bypassed part will relatively increase, i.e. the tube sections 21, 32 and 22 will be subjected to an increasing proportion of the starting voltage Us.

The impedance of the tube sections 34, 23, 33 and 24 decreases quite significantly when the discharge arc is established and the discharge current starts to flow through the tube sections 34, 23, 33 and 24. The decrease in impedance may be several orders of magnitude. This means that practically the total starting voltage Us will now fall across the bypassed part.

Finally, the gas fill will be excited into the excited state by the increased voltage in the bypassed part as well. This means that the discharge arc will be established in the complete discharge path in the discharge tube 2. As the current limiting effect caused by the bypass disappears, the discharge current increases until it is again limited by density of the charge carriers, the dimensions of the discharge tube and the exciting voltage across the electrodes 41 and 42. With appropriate dimensioning of the bypass and the discharge tube, the impedance B of the bypass may be selected to be larger than the impedance Z1 of the bypassed part when the gas is in the excited state, so that a major part of the discharge current will be conducted over the bypassed part when the discharge arc have been generated in the bypassed part as well.

When the startup of the lamp is thus completed, the discharge through the lamp is largely unaffected by the presence of the bypass. A small portion of the discharge current may flow through the bypass, but the light output of the lamp will be generated by the majority of the current flowing through the main discharge path. The narrow dimensions of the bypass will act as a current limiter, which will in effect result in an increased impedance B of the bypass. Thus as the discharge current through the tube sections 21–24 and 32–34 gradually increases until a stationary discharge is reached, simultaneously the bypass current through the bypass path decreases and stabilizes on a low level.

In this manner, it is seen that the value of the starting voltage Us need not be larger than the voltage which is necessary for starting a discharge arc through a part of the discharge path only. In the above example, the starting voltage Us is only slightly higher than half of the voltage which otherwise would be needed to start the lamp 1 without the bypass.

Another embodiment of a compact fluorescent lamp with a bypassed discharge vessel will be now explained with reference to FIGS. 4 to 9.

Figure 4:
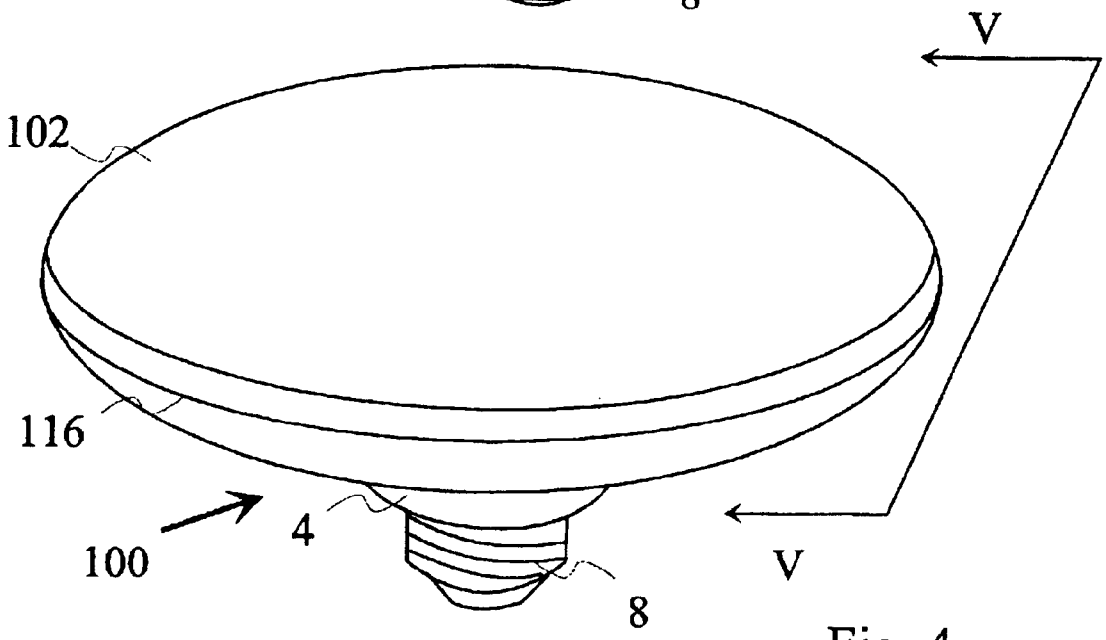
FIG. 4 is a perspective view of a flat compact fluorescent lamp with a plate-shaped discharge vessel having a planar double spiral shaped discharge path.

FIG. 4 depicts a so-called flat compact fluorescent lamp 100. The lamp 100 has a substantially disk shaped lamp head 102. The lamp head 102 comprises the discharge vessel. The discharge vessel of the lamp 100 is constituted by a flat double spiral shaped discharge channel. The spiral shaped discharge channel is formed by two convoluted walls 111, 112 between a top panel 105 and bottom panel 104. At the periphery of the panels 104, 105, an external ring wall 113 encloses the discharge volume, and the ends 131, 132 of the discharge channel are closed by end wall sections 114, 115. The convoluted walls 111, 112, the ring wall 113 and the end wall sections 114, 115 are integral with one of the panels, in the shown embodiment with the bottom panel 104.

The top and bottom panels 104, 105 are bonded to each other along a sealing 116. The sealing 116 also provides a gas-tight sealing of the discharge vessel. Such a sealing may be provided between walls 111, 112 and the top panel 105 as well.

Figure 5:
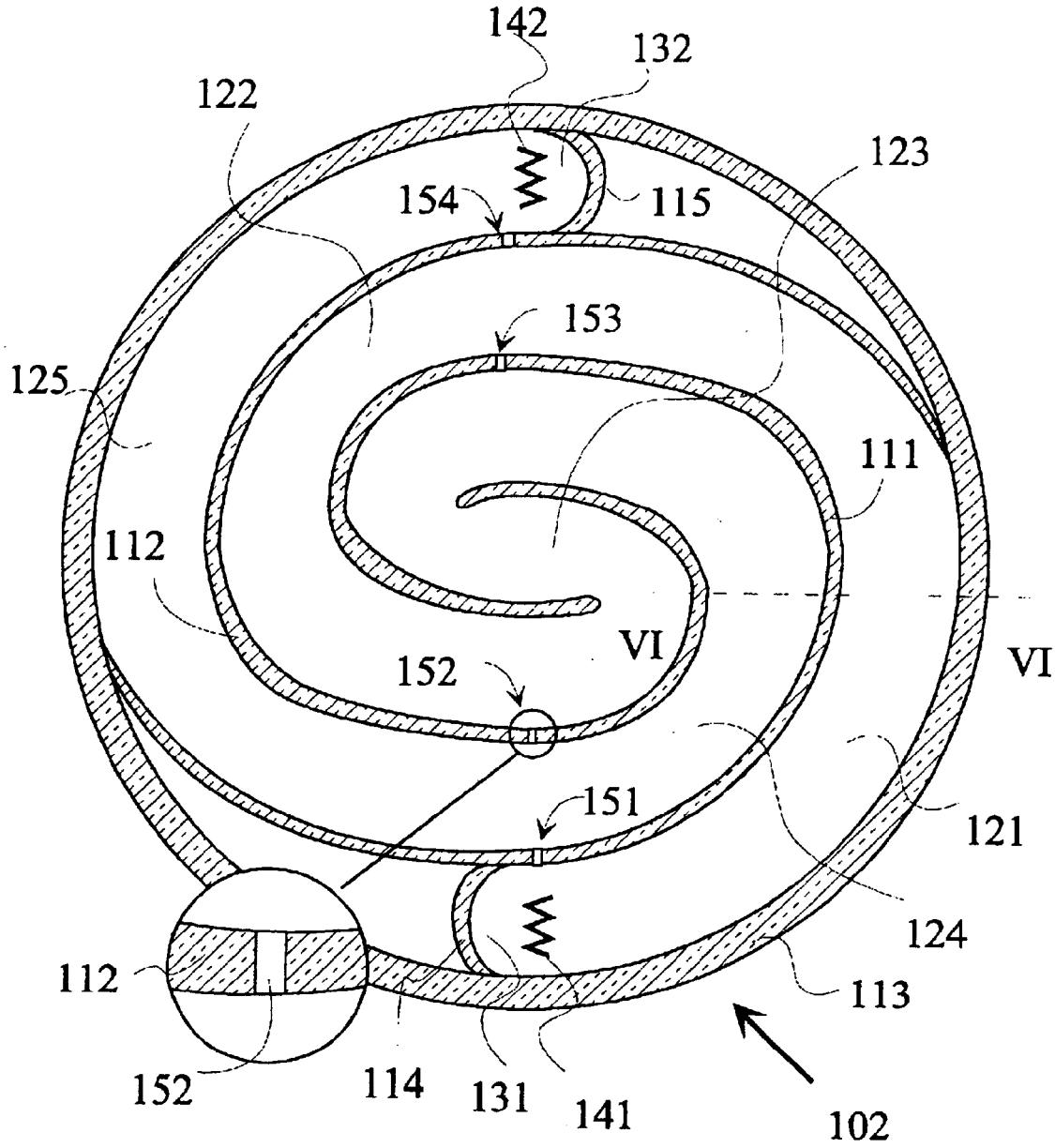
FIG. 5 is a cross-section of the discharge vessel of the lamp shown in FIG. 4, taken along the plane V—V.
Figure 6:
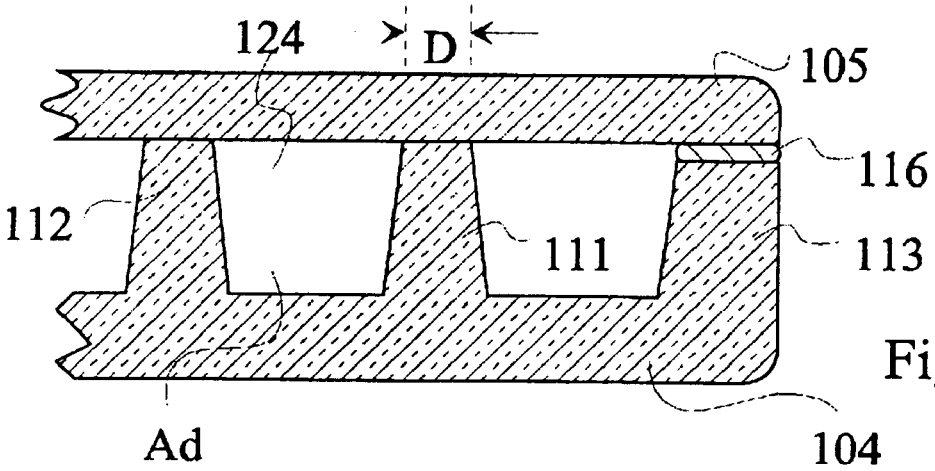
FIG. 6 is a partial cross-section of the discharge vessel of the lamp shown in FIG. 4, taken along the plane VI—VI of FIG. 5.
Figure 7:
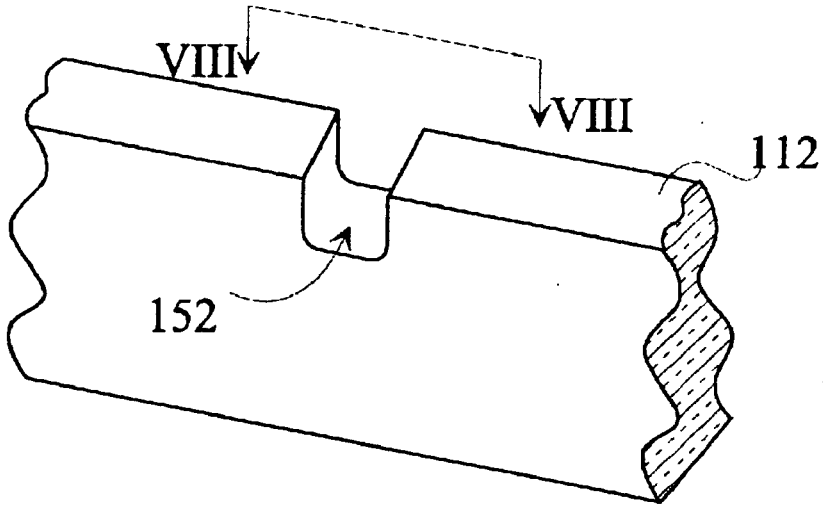
FIG. 7 is a perspective view of a wall section in the discharge vessel of the lamp shown in FIG. 4, with a bypass opening across the wall section.
Figure 8:
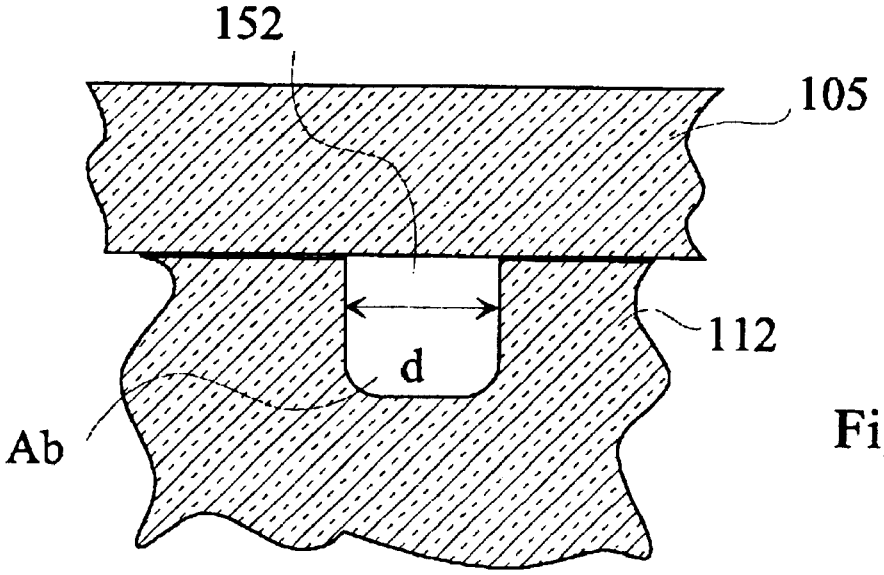
FIG. 8 is a partial cross-section of the wall section shown in FIG. 7, taken along the plane VIII—VIII of FIG. 7.

Electrodes 141, 142 are located at the ends 131, 132 of the discharge channel. As best seen in FIG. 5, due to the spiral form of the discharge channel, several sections of the discharge vessel are located adjacent to each other, separated by the walls 111, 112 only.

In the discharge vessel of the lamp head 102, the bypass means between the adjacent sections of the discharge channel are formed as openings 151–154 in the convoluted walls 111, 112. As will be shown below, these openings function as a bypass path for the gas discharge between two adjacent sections of the discharge vessel during a startup of the lamp. The bypass path created by the openings 151–154 results in a short-cut across the impedance of certain a portions of the discharge path, when the gas in these portions is in the non-excited state.

Figure 9:
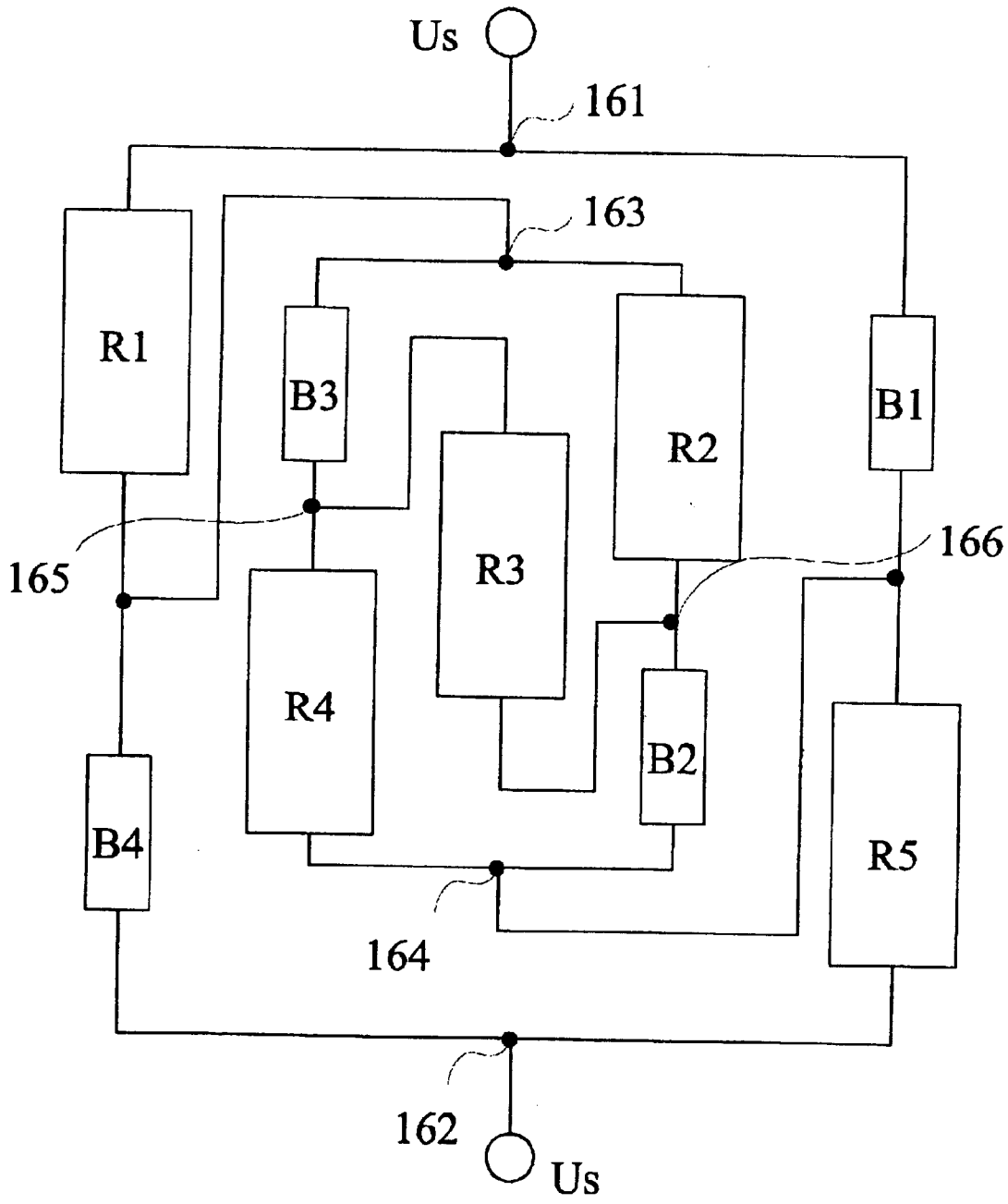
FIG. 9 illustrates the equivalent impedance circuit of the discharge vessel shown in FIG. 5.

As it will be apparent from the explanation of FIG. 9, with the spiral-shaped discharge vessel of the lamp 100, certain bypassed parts of the discharge path themselves comprise further bypassed parts and associated bypass paths. For example, as illustrated in FIG. 5, the complete double spiral shaped discharge channel of the lamp head 102 may be divided into five channel sections 121–125 by the bypass openings 151–154. The first channel section 121 extends from the first electrode 141 until the bypass openings 153 and 154. The second channel section 122 extends from the bypass openings 153 and 154 until the bypass opening 152. The third, central channel section 123 extends from the bypass openings 152 until the bypass opening 153. The fourth channel section 124 extends from the bypass opening 153 until the bypass openings 151 and 152. Finally, the fifth channel section 125 extends from the bypass openings 151 and 152 until the second electrode 142. The impedances of the channel sections 121–125 are represented by the impedances R1–R5, respectively, and the impedances of the bypass openings 151–154 are represented by the impedances B1–B4, respectively. As best perceived from FIG. 9, the impedance B1 corresponding to bypass opening 151 bypasses the impedances R1–R4 which in turn correspond to the channel sections 121–124. At the same time, channel sections 122 and 123 are themselves bypassed by the bypass opening 153. With other words, the sections of the discharge vessel are arranged adjacent each other, and multiple bypass openings 151–154 acting as bypass paths are provided between the adjacent sections.

The impedance of the bypass openings 151–154 is influenced by the dimensions of opening between the adjacent discharge channel sections 121–124. Typically, the width D of the walls 111, 112 may be between 0.5–2 mm, while the width d of the openings 151–154 is preferably not larger than 0.4 mm. Typically, the width D of the walls 111, 112 is less than five times the width d of the openings 151–154. The openings 151–154 have an almost square area, and they are conveniently as an incision in the walls 111, 112, as best seen in FIG. 1where the shape of the incision forming the opening 152 is shown in perspective. In order to direct the discharge current into the discharge channel instead of the bypass, the area Ad of the cross-section of the discharge path preferably is at least ten times the area Ab of the cross-section of the bypass openings 151–154. Other cross-section proportions are also suitable for limiting the discharge current in the discharge channel.

The discharge vessel in the lamp head 102 also contains a gas fill which is excitable from a non-excited state into an excited state by the discharge arc in the operating state of the lamp 100. This gas fill has similar properties as the known gas fills for fluorescent lamps, and particularly, the impedance of the gas fill is lower in the excited state than in the non-excited state. Therefore, the starting of the lamp 100 may be also performed with a lower starting voltage Us applied to the electrodes 141, 142, as compared with a similar flat compact lamp without the bypass openings of the invention.

The startup process of the lamp 100 will be explained with reference to FIG. 9. Firstly, the starting voltage Us is applied between the two electrodes 141, 42 across the discharge path in the spiral-shaped discharge channel of the lamp head 102. The total impedance of the discharge channel corresponds to the combined impedance of the serially connected impedances R1–R5 of FIG. 9. The bypass openings 151–154 act as the bypass impedances B1–B4. For example, the impedance B4 provides a bypass path between the nodes 162 and 163. As apparent from FIG. 9, nodes 162, 163 are the two ends of a bypassed part of the circuit, where the bypassed part contains the impedance R5 connected in series with the circuit between the nodes 163 and 164.

As explained above, the channel sections 121–125 divide the elongated discharge vessel of the lamp head 102 into multiple sections. As it is best seen in FIG. 9, the channel sections 121–125 have impedances in a non-excited state equaling a fraction of the total impedance over the discharge path, because the impedances R1–R5 are connected in series. Accordingly, only a fraction of the starting voltage Us would fall on each channel sections 121–125 in the absence of the bypass openings. Assuming the impedance of the channel sections 121–125 to be largely equal, only about one fifth of the starting voltage Us would fall across each channel section.

However, the bypass openings 151–154 divide portions of the discharge path into bypassed parts and associated remaining parts. Four such bypasses may be identified in FIG. 9. The combined impedance of each of the bypass paths and the associated bypassed parts is selected to be lower than the impedance of the respective associated bypassed part, when the gas in at least a part of the corresponding bypassed part is in the non-excited state. For example, the combined impedance of the bypass impedance B1 and the impedance of the circuit between the nodes 162 and 163 is certainly lower than the impedance of the circuit between the nodes 162 and 163 by itself, for any finite value of the impedance B4, since the impedance B4 and the circuit between the nodes 162 and 163 are connected in parallel.

In most cases, the impedance of the bypass path, i.e. the value of the bypass impedance B4 itself is selected to be lower than the impedance of the associated bypassed part. In a practical realization, the impedance of a channel section is in the order of 100 Mohm, which falls to approx. 20 ohm when the discharge arc develops in the channel section. The value of the bypass impedances B1–B4 is also in the order of 100 Mohm when the gas fill is in the non-excited state, and the final impedance of the bypass is in the order of 200 ohm when the discharge current through the bypass has stabilized. In the present example, the impedance of the bypassed part corresponds to the impedance of the circuit between the nodes 162 and 163, when the gas in the bypassed part is in the non-excited state.

It may be practical if the ratio between the impedance of the bypassed part of the discharge path and the impedance of the associated bypass path in the non-excited state of the gas fill is selected to be between 1 and 10. In this manner, assuming the value of the bypass impedances B1–B4 to be at least an order of magnitude lower than the value of the impedances R1–R5, the total impedance of the circuit between the nodes 163 and 162 will be much larger than the value of impedance B4, as it is apparent from the layout of the circuit in FIG. 9. With other words, the impedance between the nodes 163 and 162 will be determined by the value of the bypass impedance B4, which, as mentioned above, is an order of magnitude-smaller than the impedance R1.

As seen in FIG. 9, impedance R1 is connected in series with the bypass impedance B4. Accordingly, a major portion of the starting voltage Us will fall between the nodes 161 and 163. This will result in a relatively increased starting voltage Us across the remaining part of the circuit, i.e. the impedance R1. With other words, instead of a fraction of the starting voltage Us only, almost the total starting voltage Us will fall across the impedance R1. Since the impedance R1 corresponds to the first channel section 121, the gas fill will be excited in this channel section 121 into the excited state with the help of the starting voltage Us, and a discharge arc will develop in the channel section 121.

Simultaneously, the discharge arc will also develop in the channel section 125, because the same considerations apply to the impedance R5 and the bypass impedance B1 as above, these impedances being symmetrically situated relative to the impedances R1 and B4 in the circuit shown in FIG. 9. As a consequence, the impedance of the remaining parts of the discharge channel, i.e. the impedance of the channel sections 121 and 125 decreases. This, in turn, relatively increases the voltage across the bypassed part. Clearly, as the impedances R1 and R5 diminish in value, the starting voltage Us will appear on the nodes 163 and 164.

Now the same considerations may be repeated with respect to the impedances R4, R3 and R2. These are bypassed by the bypass impedances B2 and B3, respectively. As B3 bypasses the impedances R2 and R3, the starting voltage Us on the nodes 163 and 164 will appear between the nodes 165 and 164, i.e. the starting voltage Us will fall on the impedance R4, and, due to the symmetry of the circuit, also on the impedance R2. Accordingly, the corresponding channel sections 124 and 122 will be excited by the starting voltage Us, and the discharge arc develops in the channel sections 124 and 122 as well.

As the discharge current starts to flow through the channel sections 124 and 122, their corresponding impedances R2 and R4 also decrease, and the starting voltage Us will now fall on the last remaining channel section 123. Finally, the gas fill is excited by the starting voltage Us and the discharge current flows in all sections of the discharge vessel.

It is noted that in this final stage, if the bypass impedances B2, B3 are much smaller than the impedances R2–R4, almost the total starting voltage Us falls on the central impedance R3 as well, and this means that the central channel section 123 may be excited almost at the same time or even before as the channel sections 122 and 124. However, in order to ensure that channel sections 122 and 124 excite before central channel section 123, the impedance of the central channel section 123, i.e. the value of the impedance R3 should be at least as large as the impedances R2–R4. In this manner, the voltage falling on the impedances R2–R4 will be larger than the voltage falling on the impedance R3, and therefore the discharge arc will develop in the channel sections 122 and 124 before developing in the central channel section 123. If the value of the bypass impedances B2, B3 is negligible relative to the impedances R2 and R4, almost the total starting voltage Us is utilised for exciting the channel sections 122–124, and subsequently the channel section 123. In this manner, it is understood that the method significantly reduces the necessary voltage for the starting of the discharge arc in the discharge vessel.

As in the above example, the current across the bypass paths, i.e. the discharge current across the bypass openings 151–154, is limited by the effective area of the cross-section of the bypass path. For example, the area Ad of the cross section of the discharge channel may be approx. 80 $mm^2$, while the area Ab of the cross section of the bypass opening may be approx. 8 $mm^2$. The ratio between the impedance of a bypassed part of the discharge path and the impedance of the associated bypass path in the excited state of the gas fill may be between 0.01 and 0.1. Therefore, as the current increases in the channel sections 121–125, the value of the bypass impedances B1–B4 will relatively increase. This impedance increase becomes significant when all sections of the discharge channels are excited, and the discharge current starts flowing unhindered between the electrodes 141, 142 through the full length of the discharge channel. Therefore, when the discharge arc has stabilized, only a relatively small part of the discharge current will flow through the bypass openings.

It is clear for those skilled in the art that the same principle may be applied to discharge vessels with even more spiral turns, and with similar bypass paths between the turns of the spiral, and an even more significant reduction in the starting voltage may be achieved.

The invention is not limited to the shown and disclosed embodiments, but other elements, Improvements and variations are also within the scope of the invention. For example, the proposed discharge arc starting method and the bypassed discharge vessel is applicable not only with straight or flat compact fluorescent lamps, but also with other types of discharge lamps having different coil-like or arbitrary other shapes, as long as a suitable bypass can be realized between adjacent sections of the discharge vessel of the lamp.

What is claimed is:

1. A fluorescent lamp comprising an elongated discharge vessel enclosing a discharge path, the discharge vessel containing a gas fill, the gas fill being excitable from a non-excited state into an excited state by a discharge arc in the operating state of the lamp, the discharge path having a first impedance in a non-excited state; and further the impedance of the gas being lower in the excited state than in the non-excited state, further the discharge vessel having at least two sections located adjacent to each other, electrode means for generating a discharge arc across the discharge path in the discharge vessel, bypass means for providing a bypass path for the gas discharge during a startup of the lamp between the two adjacent sections of the discharge vessel, the bypass path resulting in a short-cut across the impedance of at least a portion of the discharge path when the gas in said portion is in the non-excited state.

2. The lamp of claim 1 in which the discharge vessel is constituted by a discharge channel formed by at least one wall between a top and bottom panel, and the bypass means is formed as an opening in the wall.

3. The lamp of claim 2 in which the wall is integral with one of the panels.

4. The lamp of claim 2 in which the walls is convoluted to form a spiral-shaped discharge channel.

5. The lamp of claim 2 in which the width of the wall is 0.5–2 mm.

6. The lamp of claim 2 in which the width of the opening is not larger than 0.4 mm.

7. The lamp of claim 2 in which the width of the wall is less than five times the width of the opening.

8. The lamp of claim 2 in which the opening is an incision in the wall.

9. The lamp of claim 2 in which the area of the cross-section of the discharge path is ten times the area of the cross-section of the bypass path.

10. The lamp of claim 1 in which the discharge vessel is a discharge tube and the bypass means are lead-through connections between tube sections of the discharge tube.

11. The lamp of claim 1 in which at least a part of a bypassed part of the discharge path comprises further bypassed parts and associated bypass paths.

* * * * *